US006502916B1

(12) United States Patent
Naka

(10) Patent No.: US 6,502,916 B1
(45) Date of Patent: Jan. 7, 2003

(54) INK JET PRINTING DEVICE AND AN INK CARTRIDGE

(75) Inventor: Takahiro Naka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/318,269

(22) Filed: May 25, 1999

(30) Foreign Application Priority Data

May 25, 1998 (JP) ..... 10-158659
Jul. 31, 1998 (JP) ..... 10-216847
May 20, 1999 (JP) ..... 11-139496

(51) Int. Cl.[7] ..... B41J 29/38
(52) U.S. Cl. ..... 347/14; 347/19
(58) Field of Search ..... 347/5, 6, 7, 9, 347/14, 19, 85, 86, 49

(56) References Cited

U.S. PATENT DOCUMENTS 4,320,406 A * 3/1982 Heinzl ..... 347/43
4,872,027 A * 10/1989 Buskirk et al. ..... 347/19
5,363,134 A * 11/1994 Barbehenn et al. ..... 347/49
5,506,611 A * 4/1996 Ujita et al. ..... 347/86
5,638,097 A * 6/1997 Takayanagi et al. ..... 347/7
5,725,647 A * 3/1998 Carlson et al. ..... 106/31.86
5,812,156 A * 9/1998 Bullock et al. ..... 347/19
5,835,817 A * 11/1998 Bullock et al. ..... 347/19
6,050,671 A * 4/2000 Rotering ..... 347/35
6,145,950 A * 11/2000 Ohtsuka et al. ..... 347/15
6,155,664 A * 12/2000 Cook ..... 347/7
6,158,837 A * 12/2000 Hilton et al. ..... 347/19
6,183,071 B1 * 2/2001 Sugimoto et al. ..... 347/85
6,290,321 B1 * 9/2001 Murray et al. ..... 347/19

FOREIGN PATENT DOCUMENTS

EP 0 728 587 8/1996 ..... B41J/2/175
EP 0 812 693 12/1997 ..... B41J/2/17
FR 2 744 391 8/1997 ..... B41J/2/175
WO WO 98/04414 2/1998 ..... B41J/2/17

OTHER PUBLICATIONS

Patent Abstracts of Japan vol. 097 No. 005 May 30, 1997 & JP 09 011505 A (CANON Inc) Feb. 14, 1997 *Abstract.
Patent Abstracts of Japan vol. 097 No. 003 Mar. 31, 1997 & JP 08 31007 A (OKI DATA:KK) Nov. 26, 1996 *Abstract.
Patent Abstracts of Japan vol. 015, No. 225 (M–1122) Jun. 10, 1991 & JP 03 067657 A (CANON Inc) Mar. 22, 1991 *Abstract.

* cited by examiner

*Primary Examiner*—John Barlow
*Assistant Examiner*—Blaise Mouttet
(74) *Attorney, Agent, or Firm*—Sughrue Mion, PLLC

(57) ABSTRACT

An ink jet printing device includes: first storage means, provided on a printhead, for storing data of a type of the printhead, second storage means, provided on an ink cartridge, for storing data of a kind of ink contained in the ink cartridge and types of printheads compatible with the ink cartridge; and control means operating such that the control means judges whether or not an ink cartridge is compatible with a printhead on the basis of data read out of the first and second storage means, and causes the ink jet printing device to perform a printing operation when the ink cartridge is compatible with the printhead.

19 Claims, 8 Drawing Sheets

INK JET PRINTING DEVICE AND AN INK CARTRIDGE

BACKGROUND OF THE INVENTION

1. Field of the Invention

The present invention relates to a printing device which receives ink from a replaceable ink cartridge and ejects ink droplets through nozzle orifices thereof onto a printing medium to visually record text and graphic data on the medium.

2. Related Art

The ink jet printing device includes a printhead and an ink cartridge for supplying ink to the printhead. The printhead receives print data and generates drive signal based on the print data, applies them to piezoelectric transducing elements or heat generating means to generate mechanical or thermal energy, and pressurizes ink droplets by the generated energy to eject ink droplets through the nozzle orifices thereof.

The print quality of a printed product of a printing device is determined by various factors, such as printhead resolution, ink viscosity, and ink spread in the printing medium. For improving the print quality, various approaches have been made: ink characteristic improvement, orifice diameter variation in conformity with the ink characteristic of an ink selected from among inks of the same color, changing of a quantity of an ink droplet, printhead drive method manipulation and others. An additional approach is to improve the maintenance work. Some examples of this approach are to appropriately set the period of the flushing for orifice clogging prevention, and to forcibly discharge ink from the printhead by sucking ink from the printhead being capped.

To secure a print quality of a printed product and reliability of the device, it is essential that the printhead is compatible with an ink cartridge, viz., a kind of ink contained. To this end, it is necessary to recognize and discriminate a kind of ink cartridge and the nature of ink, to grasp a type of the printhead, and to judge whether or not the printhead is compatible with the ink cartridge.

The printed product is used in various ways. For example, the print product can be used for an outdoor display, such as a poster. The poster needs to be water resistant although there is no need for it to last for a long time. The print product can also be used for storage purposes. One example is a hard copy produced by a digital camera. A light-resistant nature is required for the hard copy. There are cases where the use purpose of one print product is greatly different from that of another. An example of this case is the combination of the poster and the hard copy of the digital camera. When the printing device has been used for printing the posters and then is used for printing hard copies, the kind of ink thus far used must be changed to another kind of ink. In this case, the ink cartridge must also be replaced with another containing the ink to be used.

The ink cartridges used for the ink jet printing device are categorized into two types of ink cartridges, an ink cartridge containing black ink and an ink cartridge containing color ink or inks. Therefore, when one print purpose is changed to another print purpose, those ink cartridges must be changed to the ink cartridges suitable for the latter print purpose.

As described above, either in the case of a printing device with a printhead which has a long lifetime and is replaced with another printhead every time the print purpose is changed to another or in the case of a printing device using a disposable printhead of which the lifetime is much shorter than that of the printing device, the combination of the printhead and the ink cartridge is frequently changed. Therefore, it is necessary to exactly judge the compatibility of the printhead with the ink cartridge.

SUMMARY OF THE INVENTION

For the reasons mentioned above, an object of the present invention is to provide an ink jet printing device which is capable of judging the compatibility of a print head with an ink cartridge as mounted, to thereby avoid any misprinting and also to prevent the print head from being damaged due to an improper ink cartridge.

A second object of the invention is to provide an ink jet printing device in which, when a plurality of ink cartridges are employed, the printing device performs a printing operation when the ink cartridges as mounted are compatible with each other, so that the print quality and reliability can be assured.

Another object of the present invention is to provide an ink cartridge adaptable for an ink jet printing device having the above advantages.

To achieve the above objects, the present invention provides an ink jet printing device having a printhead for ejecting ink in the form of ink droplets, an ink cartridge for supplying ink to the printhead, and control means for controlling the printhead in accordance with print data. The ink jet printing device of the present invention is improved by first storage means, provided on a printhead, for storing data of a type of the printhead; second storage means, provided on an ink cartridge, for storing data of a kind of ink contained in the ink cartridge and types of printheads compatible with the ink cartridge; and control means operating such that the control means judges whether or not an ink cartridge is compatible with a printhead on the basis of data read out of the first and second storage means, and which causes the ink jet printing device to perform a printing operation when the ink cartridge is compatible with the printhead.

The ink jet printing device drives the printhead so that the printhead is compatible with a kind of ink, on the basis of data stored in the first and second storage means, and performs a printing operation, and further an ejection-recovery operation and an ink charging operation.

DESCRIPTION OF THE PREFERRED EMBODIMENTS

The preferred embodiments of the present invention will now be described with reference to the accompanying drawings.

Figure 1:
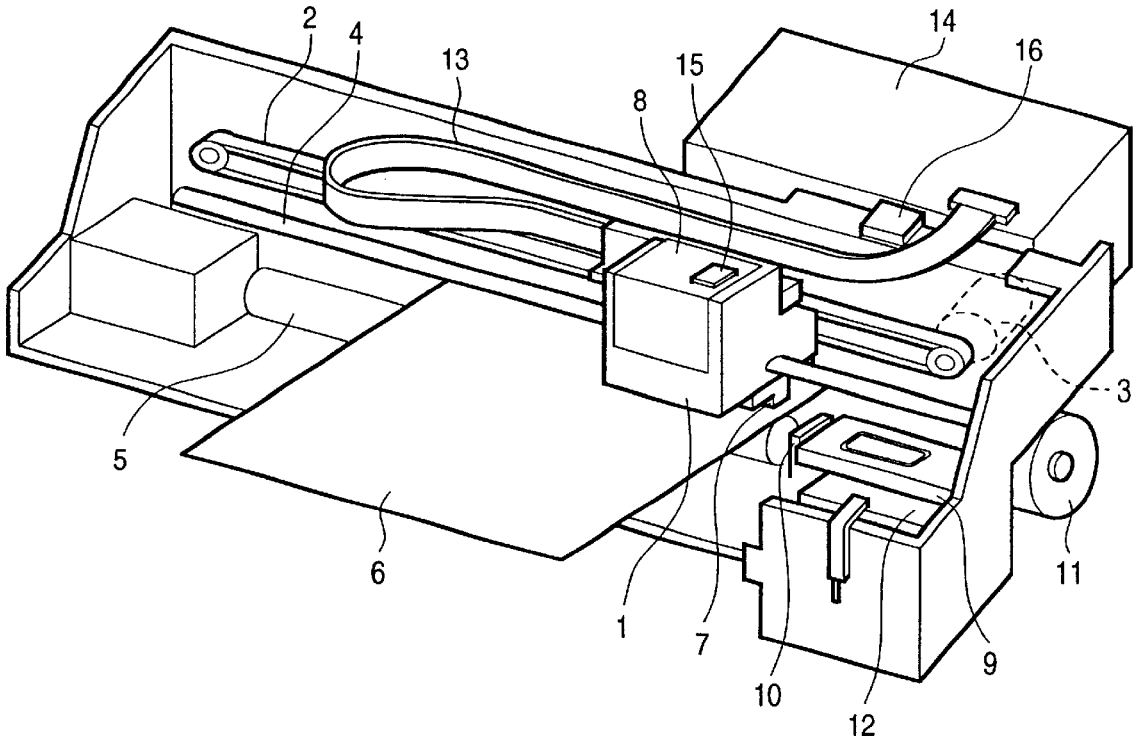
FIG. 1 is a perspective view showing an ink jet printing device constructed according to the present invention.

FIG. 1 is a perspective view showing an ink jet printing device constructed according to the present invention. In the figure, a carriage 1 couples with a motor 3 by means of a timing belt 2. The carriage 1 is movable in parallel with a platen 5 while being guided by a guide member 4. A printhead 7 is mounted on the surface of the carriage 1 which is confronted with a printing medium 6, which takes the form of a printing paper. An ink cartridge 8, which is for supplying ink to the printhead 7, is detachably attached to the upper surface of the carriage 1.

A capping member 9 for sealing the printhead 7 and a cleaning wiper 10 are located in a non-printing region within the ink jet printing device. In this embodiment, the capping member 9 is coupled to a suction pump 12 powered by a paper-feeding motor 11. When the printing device is not printing, the nozzle-orifice face of the printhead 7 is sealingly capped with the capping member 9, so that ink in the nozzle orifices is prevented from being dried. When the nozzle orifices are clogged, the capping member 9 is applied to the nozzle-orifice face of the printhead 7. In this state, the suction pump 12 applies a negative pressure to the nozzle-orifice face, and causes the printhead 7 to discharge ink therefrom.

The printhead 7 is electrically connected to control means 14 through a flexible cable 13. Communication means 16 is disposed in the vicinity of a moving path of the ink cartridge 8. The control means 14 communicates with data storage means 15 through the communication means 16.

The data storage means 15 stores data representative of the following items or character series which represent the following data:

1) kind or properties of ink contained in the ink cartridge, types of printheads that may be used,
2) effective quantity of contained ink, viz., the quantity of ink that may be used for printing, quantity of an ink droplet of each printhead,
3) flushing period of each printhead, the number of ink droplets to be ejected for flushing, flushing continuation, maintenance conditions such as drive signal voltage for flushing, signal application time and changing rates of voltage and current,
4) maintenance parameters at the time of ink charging, such as suction pressure, suction rate, pumping time and suction amount (when the ink cartridge is replaced with another in accordance with a type of printhead used, a suction pump is operated to apply a negative pressure to the nozzle orifice whereby ink is forcibly sucked from the printhead).

In a case where various kinds of data are stored by the character series, the memory capacity of the data storage means 15 can be reduced because the printing device side stores therein data for decoding the data.

Figure 2A:
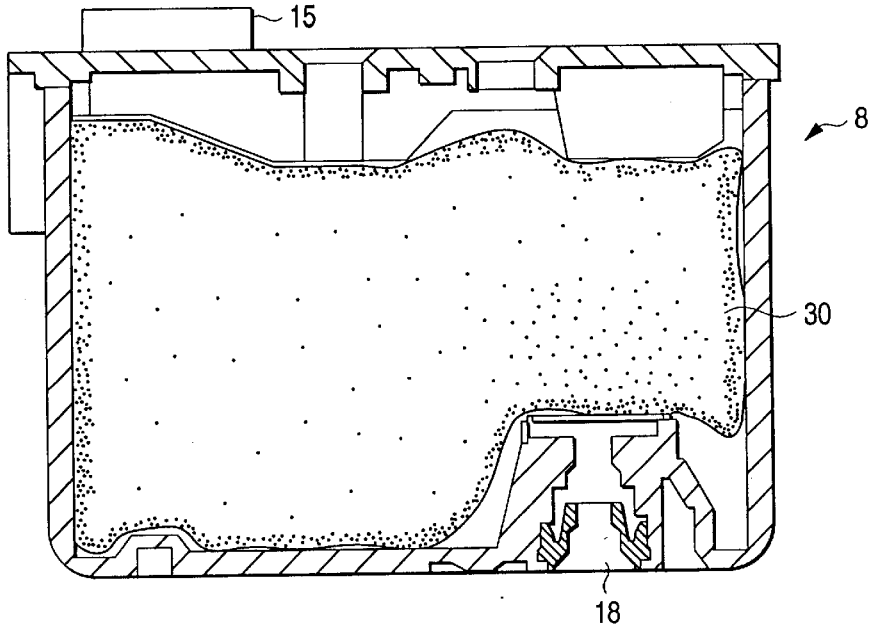
FIGS. 2A and 2B show specific structures of an ink cartridge holder mounted on a carriage and an ink cartridge attached to the holder.
Figure 2B:
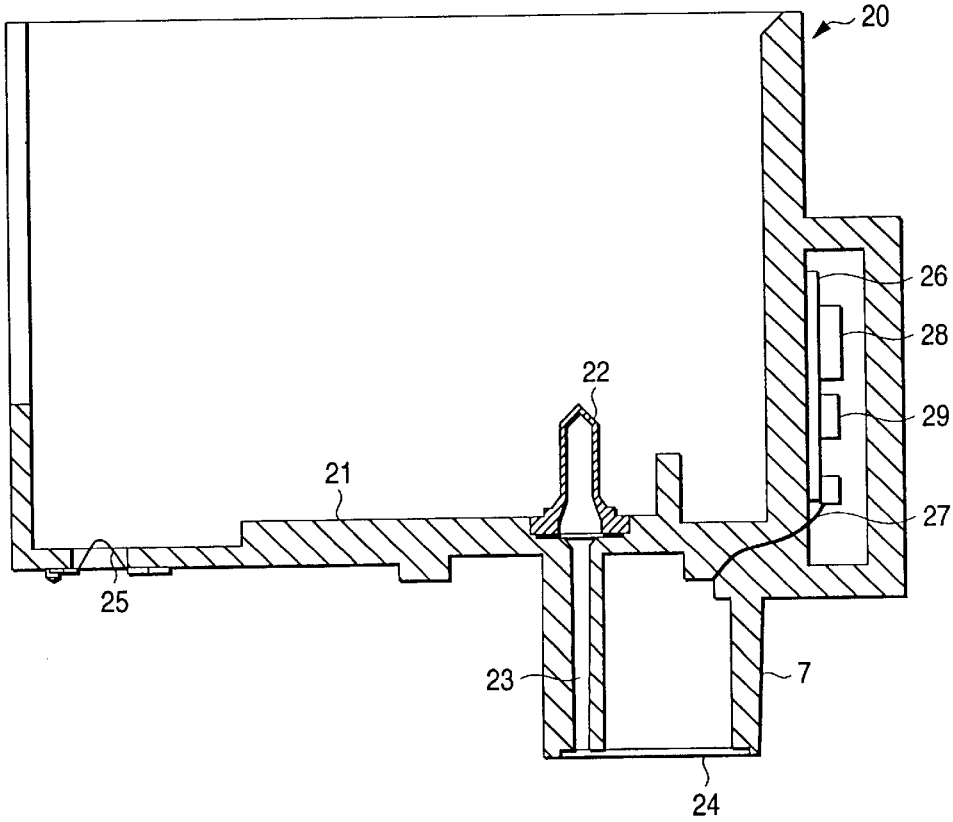

Referring to FIGS. 2A and 2B, there are shown specific structures of an ink cartridge holder 20 and the ink cartridge 8. The ink cartridge holder 20 holds the ink cartridge 8 therein. A printhead 7 is mounted on the surface of the carriage 1 which is confronted with a printing medium 6. An ink supply needle 22 is planted in a bottom surface 21 of the housing member at a position corresponding to an ink supply port 18 of the ink cartridge 8. The ink supply needle 22 is communicatively connected to an ink passage of a printhead body 24 by way of an ink supply passage 23 formed in the ink cartridge holder 20. With the connection, ink may be supplied from the needle to the printhead 7.

Cartridge-attachment detecting means 25 is fixedly attached to the surface of the ink cartridge holder 20, which is abutted against the ink cartridge (in this embodiment, it is the bottom surface 21 of the ink cartridge holder). The cartridge-attachment detecting means 25, which may be appropriate switch means, is operated when the ink cartridge 8 is attached to the carriage 1.

A circuit board 26 is mounted on one of the sides of the ink cartridge holder 20, while being electrically connected to the flexible cable 13. A drive-signal generating semiconductor device 28 and storage means 29 are fabricated into the circuit board 26. The drive-signal generating semiconductor device 28 generates printhead drive signals in response to print signals coming in through the flexible cable 13. Data representative of the type and specifications of the printhead 7, and data representative of drive conditions are stored in the storage means 29.

The printheads, even if manufactured in the same manufacturing process, are slightly different in dot size and ink droplet flying speed. Data for correcting those differences is also stored in the storage means 29.

The ink cartridge 8 includes an ink chamber 30 containing ink and an ink supply port 18, which communicates with the ink chamber 30 accommodating therein an urethane foam serving as a porous member impregnated with ink while liquid tightly engaging with the ink supply needle 22. The data storage means 15 is mounted on a location of the ink cartridge 8, which does not hinder the attachment of the ink cartridge 8 to the ink cartridge holder 20. In this embodiment, such a location is the upper surface of the ink cartridge 8.

The communication of the communication means 16 with the data storage means 15 is performed in a wireless manner. In an alternative, a contact is provided on the surface of the ink cartridge 8 where the cartridge is confronted with the ink cartridge holder 20, and the data storage means 15 is connected to the contact by means of a cable to set up a communication path between the data storage means 15 and the control means 14.

Figure 3:
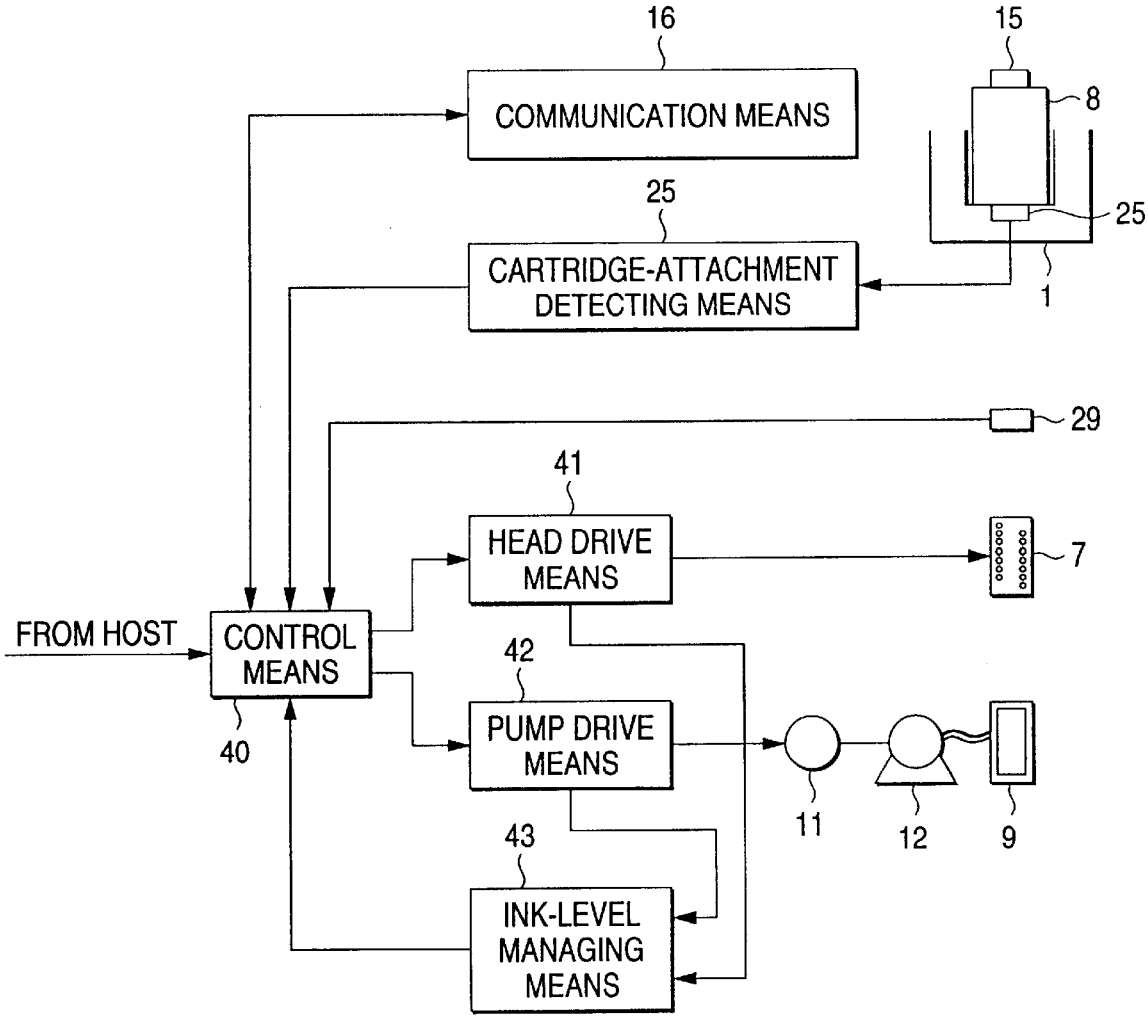
FIG. 3 is a block diagram showing a control system incorporated into the ink jet printing device of the invention.

Turning now to FIG. 3, there is shown a control system which is incorporated into an ink jet printing device, which is constructed according to the present invention. In the figure, control means 40 receives print data from a host computer (not shown) and controls the carriage-drive motor 3 in accordance with the print data, and controls head drive means 41 of the drive-signal generating semiconductor device 28 of the printhead 7. To this end, the control means 40 generates drive control signals based on the print data, and drive signals for the flushing (for orifice-clogging removal).

Pump drive means 42 controls the number of revolutions and a suction time of the suction pump 12 when the ink cartridge 8 is replaced with another cartridge or when the printhead 7 suffers from clogging. In this case, the suction pump is driven to apply a negative pressure to the printhead 7 in a state that the printhead is sealed with the capping member 9.

Residual ink-level managing means 43 calculates a consumption quantity of ink by using the quantity of contained ink that may be used for printing and the quantity of one ink droplet, which are stored in the data storage means 15 of the ink cartridge 8, and drive conditions of the drive by the head drive means 41, and then a quantity of residual ink (residual ink level) in the ink cartridge 8.

Figure 4:
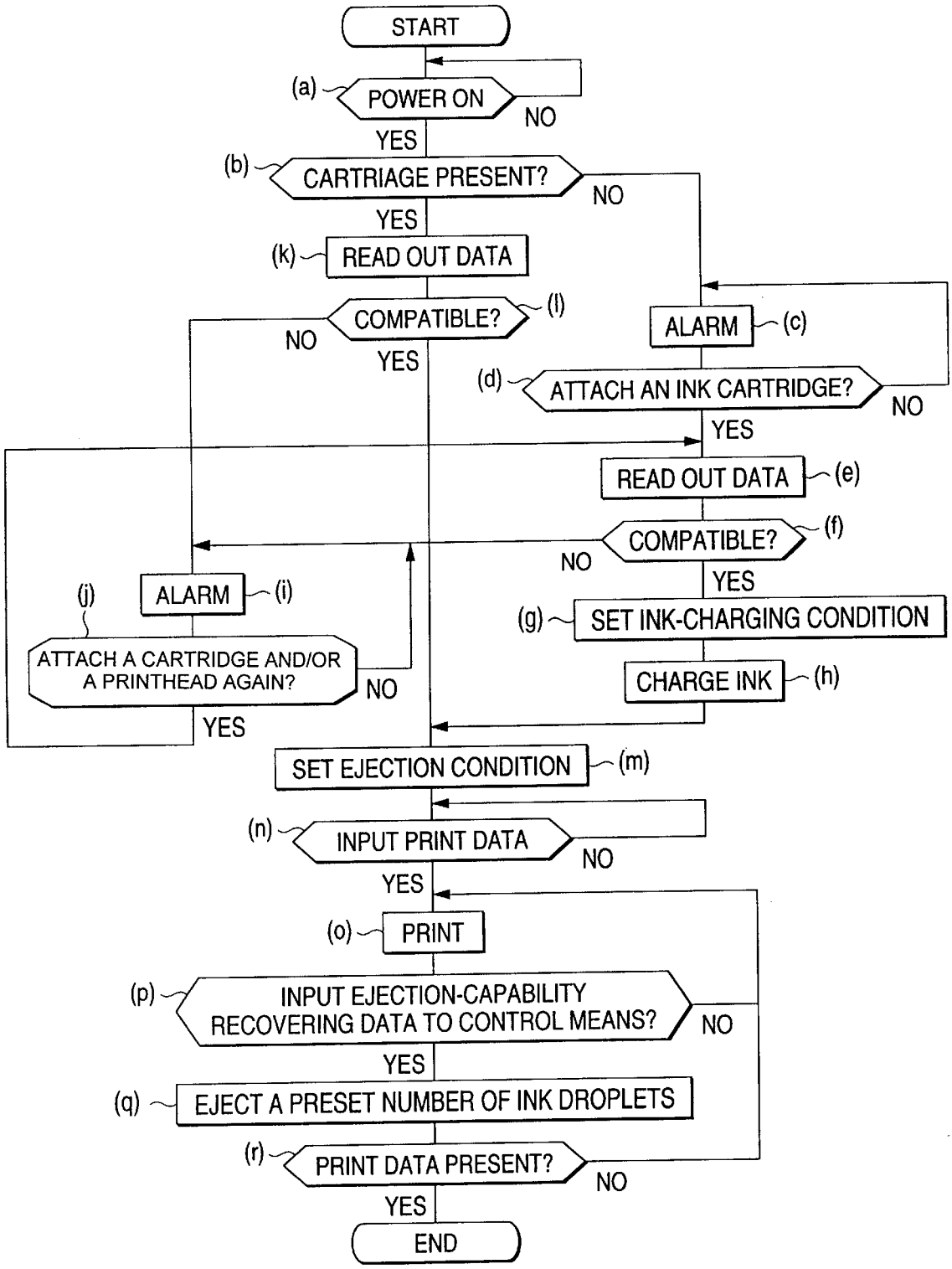
FIG. 4 is a flow chart showing the operation of the control system of the printing device.

The operation of the control system of the printing device arranged as above, will be described with reference to FIG. 4 showing a flow chart.

Upon power on (step (a)), the control means 40 judges whether or not the ink cartridge 8 is attached to the carriage (step (b)). When it is not attached, an alarm is generated to request the user to attach the ink cartridge to the carriage (step (c)).

Responding to the alarm, the user attaches an ink cartridge 8 to the carriage (step (d)). Then, the control means 40 reads data out of the data storage means 15 of the ink cartridge 8 and the storage means 29 of the printhead 7 (step (e)), and judges whether or not the ink cartridge 8 is compatible with the printhead 7 (step (f)).

When the answer is YES, the control means 40 reads ink charging conditions from the data storage means 15 and the storage means 29 (step (g)).

The pump drive means 42 moves the carriage 1 up to a capping position and caps the printhead 7 with the capping member 9. Then, the pump drive means 42 controls preset charging conditions, i.e., a suction force and a suction time of the suction pump 12, and causes the printhead 7 to forcibly discharge ink at a suction pressure and a suction time, which are suitable for structural conditions of the attached printhead 7, such as the number of nozzles and the nozzle orifice diameter, and ink properties, e.g., ink viscosity of the ink cartridge 8. With the pumping action, when a printhead is first attached to the carriage, ink is charged to the printhead while discharging out of the printhead a liquid which was charged into the printhead 7 at a factory. When it is replaced with another printhead, the ink charging is performed while discharging out of the printhead air bubbles entering the printhead 7 when the ink cartridge 8 is attached to and detached from the carriage.

Where the number of nozzles of the printhead 7 attached is large or ink contained in the ink cartridge 8 has high viscosity, the suction pressure is increased to secure a reliable charging of ink. Where the number of nozzles of the printhead is small or the nozzle orifice diameter is large, the suction pressure is decreased to decrease ink consumption.

When an ink cartridge not compatible with the printhead is loaded or a replaced printhead is not compatible with the ink cartridge, an alarm is issued to call on the user to replace the ink cartridge 8 or the printhead 7 with a compatible one (step (i)). With this, print quality degradation resulting from the use of an improper ink and wear of the printhead 7 are prevented in advance.

When a new ink cartridge 8 or a new printhead 7 is substituted for the old one (step (j)), the control means returns to step (e) and judges whether or not the new ink cartridge or the new printhead is compatible with the printhead or the ink cartridge.

When an ink cartridge 8 has been attached at the time of power on (step (b)), the control means reads data from the data storage means of the print head 7 and the ink cartridge 8, and judges whether or not the ink cartridge is compatible with the printhead (step (1)). If the answer is NO, an alarm is issued to call on the user to replace the ink cartridge 8 or the printhead 7 with a suitable one (steps (i) and (j)).

When it is confirmed that proper ink has been charged into the printhead 7, the control means reads data from the data storage means 15 of the ink cartridge 8 and the storage means 29 of the printhead 7; sets ink-drop ejection conditions at the time of printing or recovering of ejection capability (step (m)); and waits for the inputting of print data (step (n)).

When print data comes in this state, the control means 40 causes the head drive means 41 to output drive signals to form dots on the printing paper in accordance with the print data under the conditions described by the data read out of the data storage means 15 of the ink cartridge 8 and the storage means 29 of the printhead 7. At this time, the control means adjusts voltage value, voltage applying time, and changing rates of voltage and current with consideration to the ink-drop discharging characteristic of the printhead stored in the storage means 29 of the printhead 7, and causes the printhead 7 to eject ink droplets through its nozzle orifices so that the dots formed are equal in size to those formed by the same type of printhead and the dots formed by the ink droplets ejected through all the nozzle orifices are uniform in size (step (o)).

When a signal representative of a flushing period indicated by ejection-capability restoring data stored in the data storage means 15 for each type of printhead (step (p)) is input to the control means 40, then the control means moves the carriage 1 to a region out of the printing region, and confronts the printhead 7 with an ink receptacle, e.g., the capping member 9; it produces drive signals to the printhead 7; and causes the printhead 7 to eject the number of ink droplets defined by the ejecting-capability data or the number of ink droplets corresponding to a determined quantity of ink (step (q)).

In a case where the printhead used has a small orifice size, and the ink used contains a solvent having a high evaporating rate and a high viscosity increasing rate, the flushing period is set to be relatively short or the quantity of ink ejected through the flushing operation is increased.

The ink-level managing means 43 counts the number of ink droplets ejected from the printhead 7 at the time of the printing operation or at the time of the ejection-capability recovering operation. It then multiplies the count by the ink quantity per ink-drop stored in the data storage means 15 of the ink cartridge 8, and adds the quantity of ink ejected in the form of ink droplets to the quantity of ink sucked by the suction pump 12 (residual ink level management); and stores the quantity of ink left in the ink cartridge 8 into the data storage means 15 thereof. When the control means 40 judges that the residual ink level is near the end, an alarm is generated to request the user to replace the present ink cartridge with a new one.

Also in this case, the ink contained in the ink cartridge 8 can be fully utilized for printing irrespective of the combination of the printhead 7 and the ink cartridge 8 since the quantity of each ink droplet and the quantity of ink sucked by the suction pump 12 are stored (in the form of data) for the type of the printhead 7 in the data storage means 15.

Even in the case of one printhead, the quantity and the flying speed of the ink droplet can be adjusted by changing drive conditions of the printhead.

The quantity of ink used in every printhead and in every drive condition can be computed if the data representative of the type and drive conditions of the printhead are stored in the storage means 29 of the printhead 7, and the drive conditions of the printhead 7 are compatible with the ink cartridge 8, and the quantity of ink contained in the ink cartridge are stored in the data storage means 15 of the ink cartridge 8. Such an operation is continued till the print data terminates (step (r)).

Figure 5:
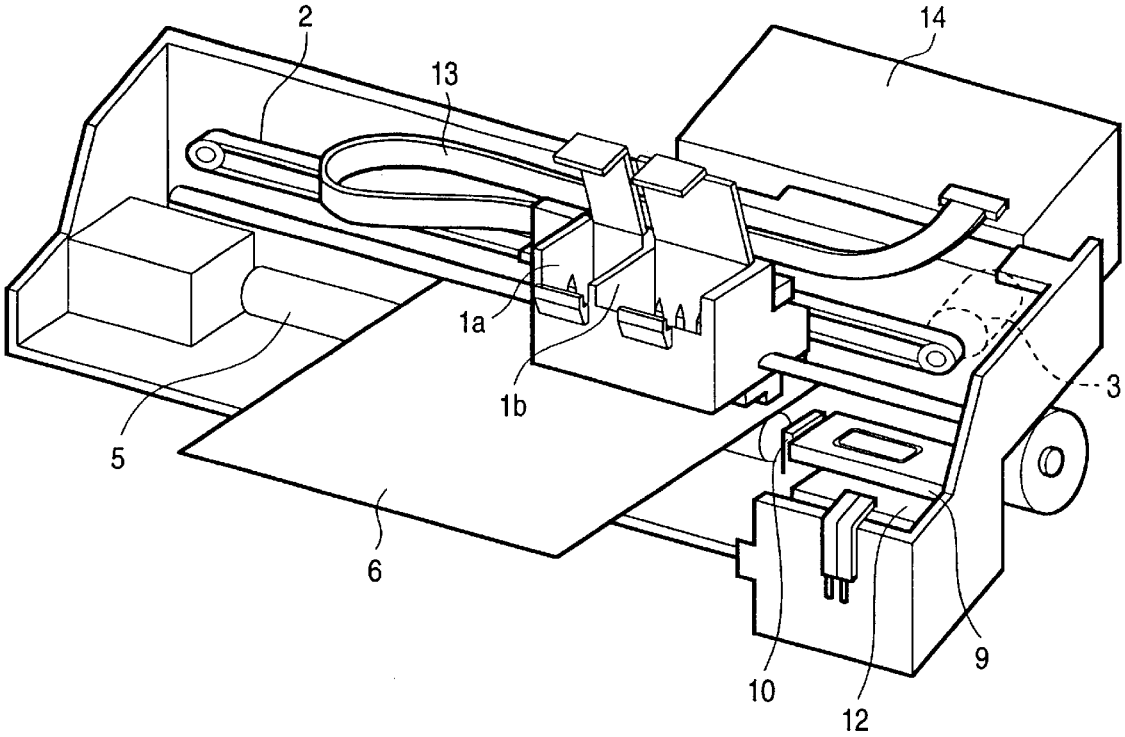
FIG. 5 is a perspective view showing an ink jet printing device which is another embodiment of the present invention.

An ink jet printing device for color printing is illustrated in FIG. 5. As shown, in this case, the carriage 1 includes two cartridge receptacles 1*a* and 1*b*, one for receiving a black ink cartridge 50 containing black ink and the other for receiving a color ink cartridge 51 containing color ink or inks.

When one of the ink cartridges is used up and needs to be replaced with a new one, or when the specification of the print product is changed to another and the ink cartridge is replaced with another ink cartridge to change a type of ink to another type of ink, the user tends to mistakenly attach ink cartridges having specifications which are different for black ink and color ink.

Figure 6:
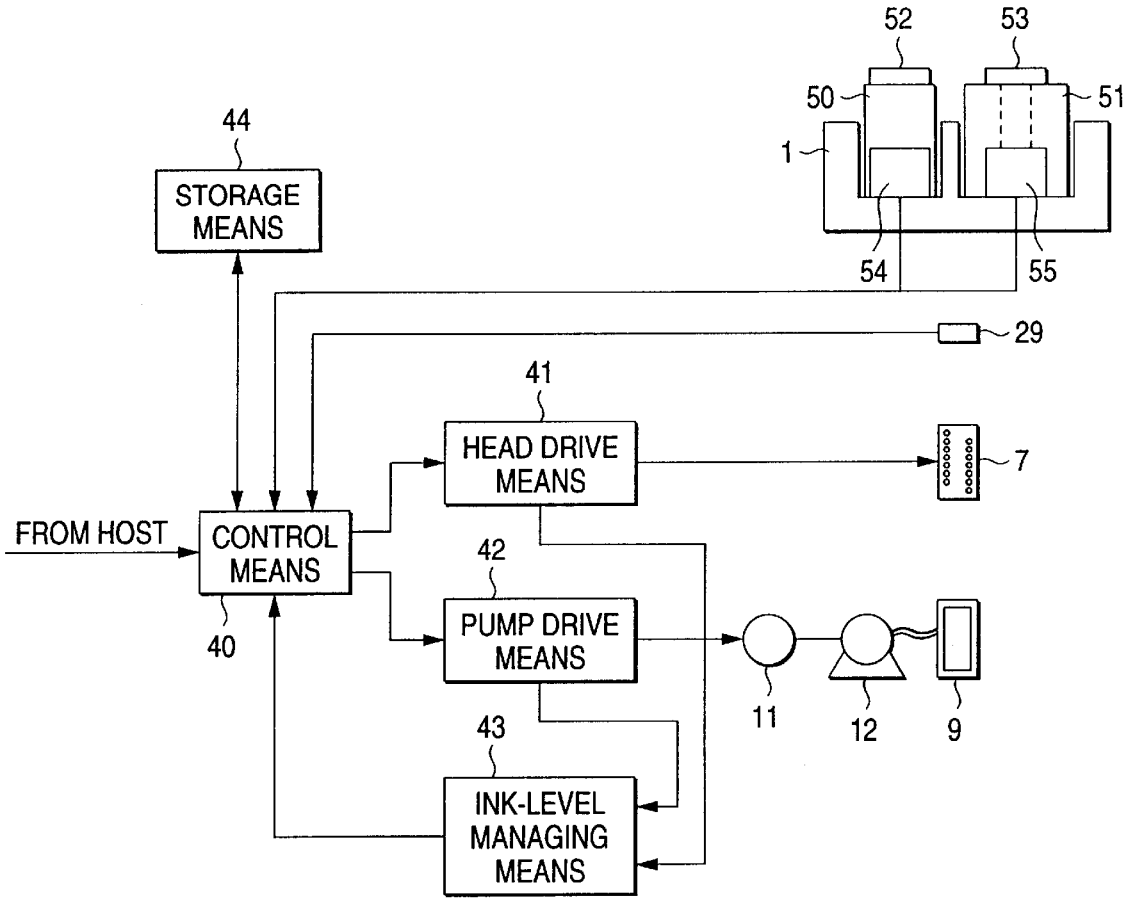
FIG. 6 is a block diagram showing a control system incorporated into the FIG. 5 printing device.

Referring to FIG. 6, there is shown a control system of an ink jet printing device which is designed to cope with the mistaken attachment of the ink cartridges. As shown, storage means 52 and 53 are attached to the ink cartridges 50 and 51, respectively. The control means 40 accesses the storage means 52 and 53 through communication means (which takes the form of contact members 54 and 55 in this embodiment).

The control system of this embodiment includes storage means 44 that may be accessed by the control means 40. The storage means 44 stores data indicating whether or not the two ink cartridges attached to the printhead are compatible.

Figure 7A:
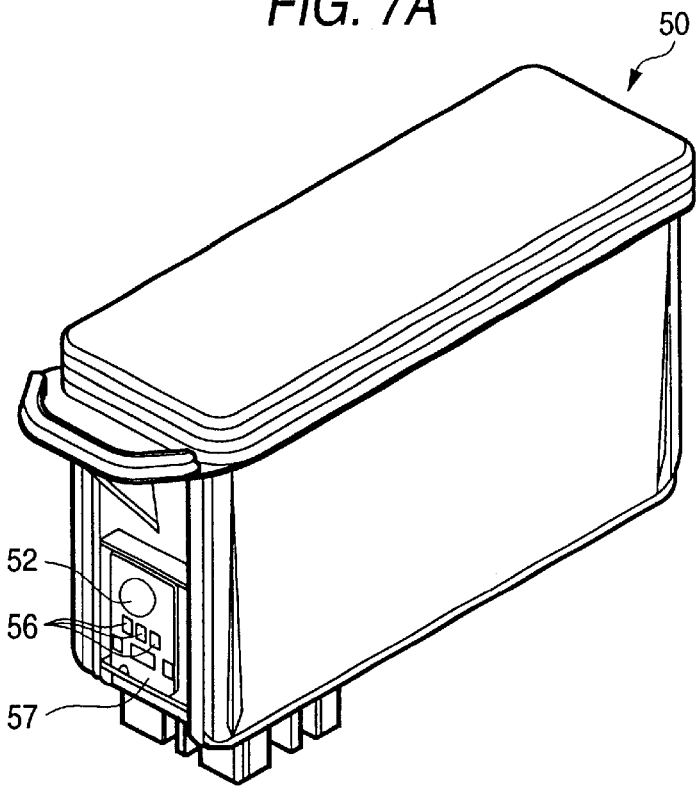
FIGS. 7*a* and 7*b* show a structure including an ink cartridge and a carriage.
Figure 7B:
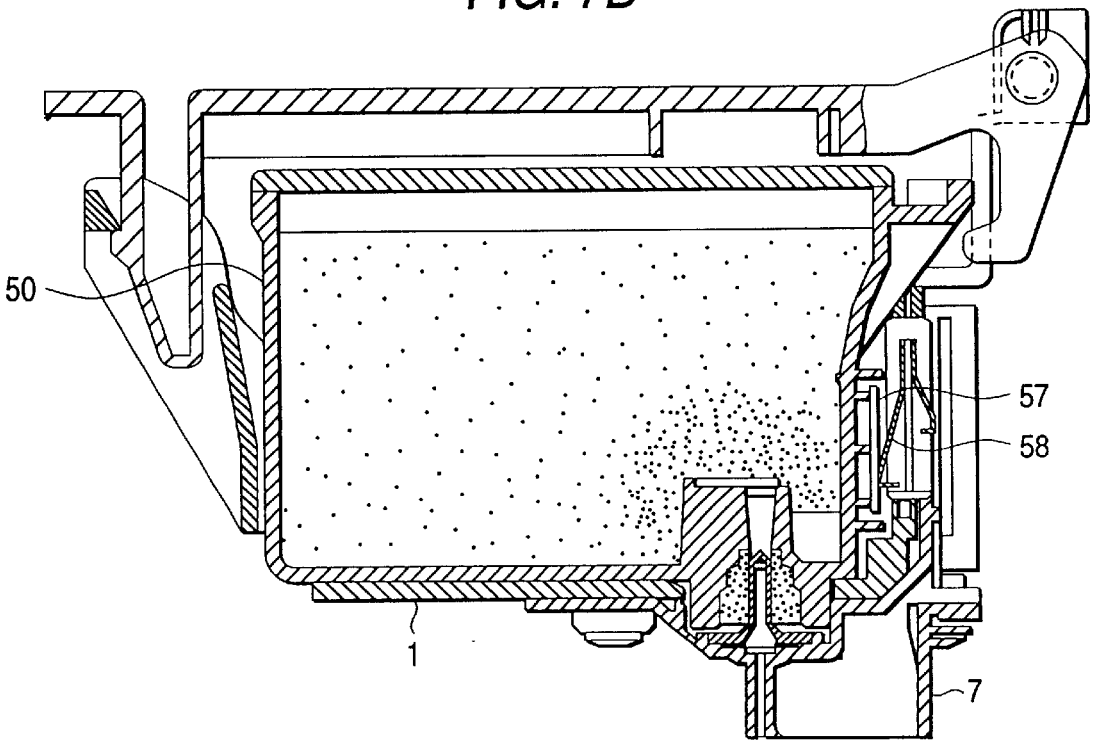

FIGS. 7*a* and 7*b* show a structure including a black ink cartridge and a carriage. The ink cartridge accesses its storage means in a contact manner. Semiconductor storage means 52 is mounted on the surface (side surface in this instance) of the ink cartridge which is confronted with the carriage 1 when it is attached to the carriage 1. A circuit board 57 is mounted on the same surface. The board 57 includes an electrode 56 to be in contact with the semiconductor storage means 52. A contact 58 is provided on the carriage. The contact 58 is resiliently pressed against the electrode 56 of the circuit board 57.

The storage means 52 and 53 of the black ink cartridge 50 and the color ink cartridge 51 store the data representative of the following items or character series which represent the following data:

1) kind or properties of ink contained in the ink cartridge, types of printheads that may be used,
2) effective quantity of contained ink, viz., the quantity of ink that may be used for printing, quantity of an ink droplet of each printhead,
3) flushing period of each printhead, the number of ink droplets to be ejected for flushing, flushing continuation, maintenance conditions such as drive signal voltage for flushing, signal application time and changing rates of voltage and current,
4) maintenance parameters at the time of ink charging, such as suction pressure, suction rate, pumping time and suction amount (when the ink cartridge is replaced with another in accordance with a type of printhead used, a suction pump is operated to apply a negative pressure to the nozzle orifice whereby ink is forcibly sucked from the printhead), and
5) data representative of a kind or specification of ink contained in one of ink cartridges to be attached or a type of the same.

In a case where various kinds of data are stored by the character series, the memory capacity of the data storage means 52, 53 can be reduced because the printing device side stores therein data for decoding the data.

The black and color inks for printing on a high light-resistant printing paper at high quality, used for outdoor display, are different in viscosities and color development from the ink used for usual business document printing. Therefore, the black and color ink cartridges 50 and 51 used for producing the print for outdoor display must be those exclusively used for this purpose; otherwise, a print quality of the resultant print product will be unsatisfactory.

For this reason, it is necessary to judge whether or not the two ink cartridges 50 and 51 are appropriate to the print purpose before the color printing.

Figure 8:
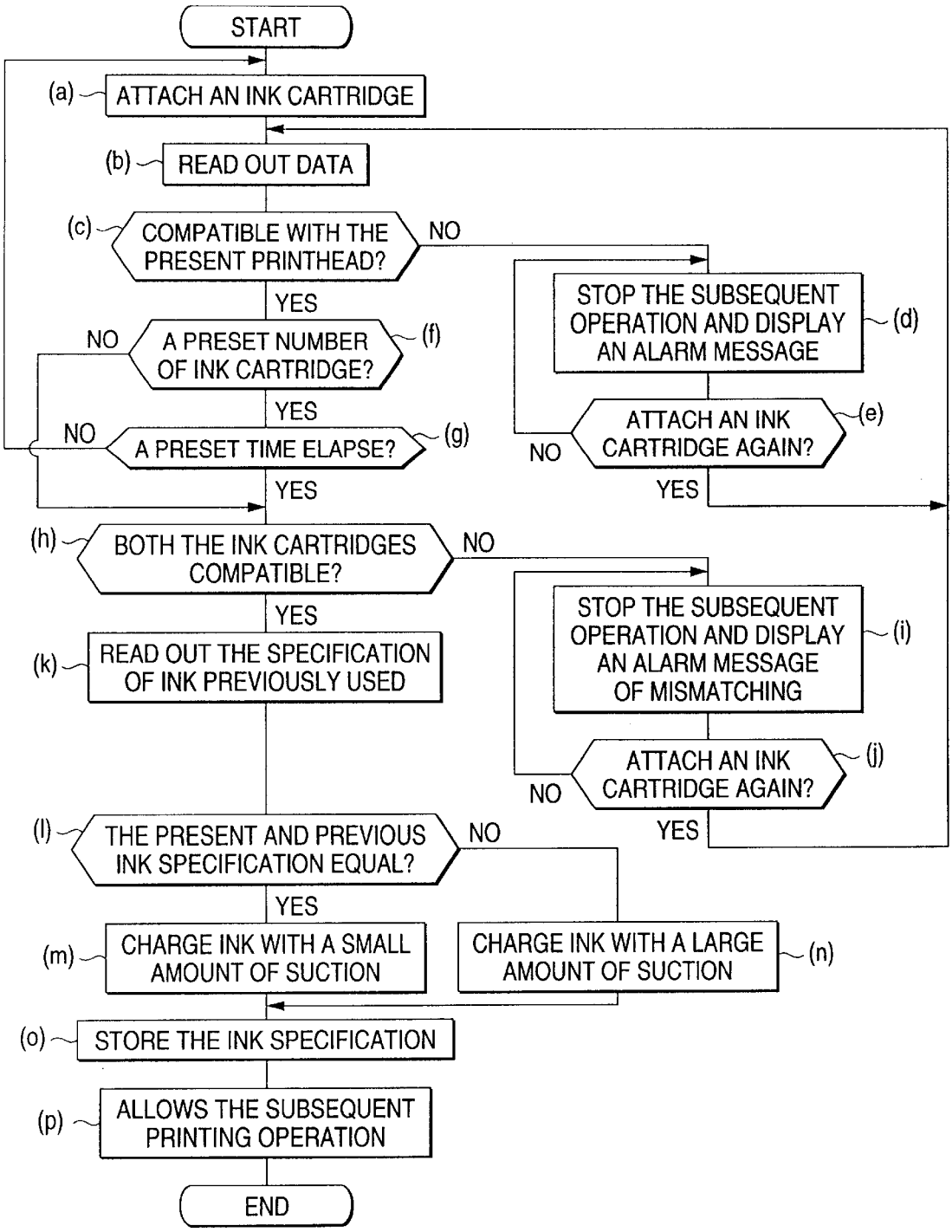
FIG. 8 is a flow chart showing the operation of the control system of the FIG. 5 printing device.

The present embodiment judges a type of ink cartridge to be used as shown by the flow chart in FIG. 8.

As shown, when the black ink cartridge 50 is attached to the carriage 1 (step (a), the control means 40 reads data out of the semiconductor storage means 52 of the black ink cartridge 50, and judges whether or not the ink cartridge is compatible with the printhead 7 (step (c)).

When the compatibility of the cartridge with the printhead is unknown or the cartridge is incompatible with the same, the ink jet printing device does not perform the operation of charging ink into the printhead and stops the subsequent operation. Further, the control means causes display means of the printing device or the host computer to display an alarm message "The black ink cartridge is incompatible with the printhead" (step (d)), and waits till another ink cartridge is attached to the carriage (step (e)).

When an ink cartridge, which is attached again or first attached to the carriage, is compatible with the printhead 7, the control means checks if a preset number of ink cartridges have been set to the carriage 1 (step (f)).

When the next ink cartridge (color ink cartridge in this embodiment) is attached to the carriage before a preset time elapses, the control means 40 reads data from the storage means 53 (step (b), and judges whether or not the attached ink cartridge is compatible with the present printhead 7 (step (c)). When the preset time elapses, the control means advances to the next step.

When the compatibility of the ink cartridge with the printhead is unknown or the cartridge is incompatible with the printhead, the ink jet printing device does not perform the operation of charging ink into the printhead and stops the subsequent operation. Further, the control means causes display means of the printing device or the host computer to display an alarm message "The black ink cartridge is incompatible with the printhead" (step (d)), and waits till another ink cartridge is attached to the carriage (step (e)).

When the color ink cartridge is compatible with the printhead 7, the control means 40 judges whether or not the print specifications of the black ink cartridge 50 are equal to those of the color ink cartridge 51 (step (h)). When those are not equal, viz., the former is for the outdoor display printing while the latter is for business document printing purpose, the control means stops the subsequent operation of the printing device, and causes display means of the printing device or the host computer to display an alarm of mismatching of the cartridge specifications.

When the user replaces one of the ink cartridges with another cartridge in response to an alarm message (step (j)), the control means 40 repeats the steps (b) to (e). When it confirms that the ink cartridge is compatible with the printhead 7, and that the specifications of the ink cartridges are equal, the control means 40 reads the specifications of the previous black and color ink cartridges 50 and 51 that are stored in the storage means 44 (step (k), and checks whether or not the specifications of the present ink cartridges 50 and 51 are equal to those of the previous ink cartridges 50 and 51 (step (l)). When the specifications of those cartridges are equal, the control means causes the suction pump to suck such a quantity of ink (e.g., 0.2 cc) as to remove air bubbles entering the printhead 7 at the time of cartridge replacement, through the pump drive means 42 (step (m)).

When the specifications of the replaced ink cartridge are different from those of the previous ink cartridge, a relatively large quantity of ink is forcibly sucked to remove the ink of the previous ink cartridge which is left in the printhead 7 and the passageway. This quantity of ink to be sucked is approximately 0.4 cc (step (n).

When the operation of charging ink to the printhead 7 terminates, the control means 40 stores data of the specifications of the black and color ink cartridges 50 and 51 into the storage means 44 (step (o)), and allows the printing device to perform the subsequent operation (step (p)).

The ink jet printing device thus constructed successfully prevents print quality degradation, caused by a mistaken selection of the ink cartridge.

While the semiconductor storage means are used for the storage means for storing various data in the above-mentioned embodiments, it will readily be understood that the semiconductor storage means may be substituted by any other suitable storage means, such as magnetic storage means and optical storage means.

In the above-mentioned embodiment, to supply ink to the printhead, the ink cartridge or cartridges are mounted on the carriage. Alternatively, ink may be supplied to the printhead by use of an ink supply tube provided in the housing.

In addition, according to the embodiment as described above, it is judged whether the ink cartridge is compatible with the print head. However, it is not necessary to judge the compatibility of the ink cartridge with the print head in a case where the printing device employs a print head which has high compatibility. In this case, mere judgement of the compatibility of the ink cartridges may be sufficient, and a desired quality of the printing result can be achieved.

As seen from the foregoing description, an ink jet printing device constructed according to the present invention comprises: first storage means, provided on a printhead, for storing data of a type of the printhead; second storage means, provided on an ink cartridge, for storing data of a kind of ink contained in the ink cartridge and types of printheads compatible with the ink cartridge; and control means operating such that the control means judges whether or not an ink cartridge is compatible with a printhead on the basis of data read out of the first and second storage means, and which cause the ink jet printing device to perform a printing operation when the ink cartridge is compatible with the printhead. Accordingly, the ink jet printing device is uniquely constructed and can produce the following advantages. First, the printing device prevents print defects and damage of the printhead, which are caused by the incompatibility of the ink cartridge with the printhead. The ejection capability of the printhead can be recovered in accordance with ink characteristic variation and change of the type of the printhead by using the data stored in the first and second storage means, and further the charging of ink to the printhead can be performed. Therefore, the performance of the printing device, even if it is of the conventional type, is improved, with the improvement of the ink and the printhead.

What is claimed is:

1. An ink jet printing device having a printhead for ejecting ink in the form of ink droplets, an ink cartridge for supplying ink to said printhead, and control means for controlling said printhead in accordance with print data, the ink jet printing device comprising:

first storage means for storing data of types of printheads;

second storage means, provided on the ink cartridge, for storing data associating a kind of ink contained in said ink cartridge and types of printheads compatible with said ink cartridge, said data being determined and stored in said second storage means before said ink cartridge is inserted into said ink jet printing device; and control means operating such that said control means judges whether or not the ink cartridge is compatible with the printhead on the basis of data read out of said first and second storage means, and causes said ink jet printing device to perform a printing operation when the ink cartridge is compatible with the printhead.

2. An ink jet printing device according to claim 1, wherein said first storage means for storing data of a type of the printhead is provided on the printhead.

3. An ink jet printing device according to claim 1, wherein data each representative of a quantity of one ink droplet ejected from each type of printhead are stored in said second storage means.

4. An ink jet printing device according to claim 1, wherein maintenance data each representative of each type of printhead are stored in said second storage means.

5. An ink jet printing device according to claim 1, wherein data representative of drive conditions for said printhead are stored in said first storage means, and data each representative of a quantity of ink consumed for the drive conditions of each compatible printhead are stored in said second storage means.

6. An ink jet printing device, comprising:

a printhead for ejecting black ink and color ink in the form of ink droplets;

at least two ink cartridges for supplying ink to said printhead, wherein at least one of said ink cartridges includes a data storage means for storing data of types of inks; and control means for controlling said printhead in accordance with print data, said control means judges whether said ink cartridges as mounted are compatible or incompatible with each other on the basis of the data stored in said data storage means, and causes said ink jet printing device to perform a printing operation when said ink cartridges are compatible with each other.

7. An ink jet printing device according to claim 6, wherein said data storage means of said at least one of said ink cartridges, stores therein data representing the kind of printheads which are compatible with said at least one of said ink cartridges, and said control means judges the compatibility of said at least one of said ink cartridges with said printhead and allows the printing device to perform a printing operation when they are compatible with each other.

8. An ink jet printing device according to claim 6, wherein said control means changes a quantity of ink to be sucked at the time of charging ink to said printhead in accordance with specifications of the inks before and after at least one of said at least two ink cartridges is replaced with another.

9. An ink jet printing device according to claim 6, further comprising storage means for storing specifications of the ink contained in a previously attached ink cartridge.

10. An ink cartridge for an ink jet printing device having a printhead, comprising:

a housing containing ink therein;

an ink supply port for supplying ink in said housing to the printhead of the printing device; and a storage device disposed on said housing which contains data associating a kind of the ink contained in said housing and types of printheads compatible with the ink cartridge, said data being determined and stored in said storage device before said ink cartridge is inserted into said ink jet printing device.

11. An ink cartridge for an ink jet printing device having a printhead, comprising:

a housing containing ink therein;

an ink supply port for supplying ink in said housing to the printhead of the printing device; and a storage device provided on the ink cartridge for storing data representative of kinds of inks that may be used if those kinds of inks are properly combined for printing and for storing data regarding the compatibility of the ink cartridge with another ink cartridge.

12. An ink cartridge for an ink jet printing apparatus having a print-head, comprising:

a housing containing ink therein;

an ink supply port disposed on said housing for supplying ink in said housing to the print-head; and a storage device disposed on said housing which contains data associating a kind of ink contained in said ink cartridge and types of printheads compatible with said ink cartridge and a quantity of one ink droplet ejected from each type of the printhead, said data being determined and stored in said storage device before said ink cartridge is inserted into said ink jet printing apparatus.

13. An ink jet printing system having a printhead for ejecting ink in the form of ink droplets, an ink cartridge for supplying ink to said printhead, and control means for controlling said printhead in accordance with print data, the ink jet printing system comprising:

first storage means for storing data of types of printheads;

second storage means, provided on the ink cartridge, for storing data associating a kind of ink contained in said ink cartridge and types of printheads compatible with said ink cartridge, said data being determined and stored in said second storage means before said ink cartridge is inserted into said ink jet printing system; and control means 1) for judging whether or not the ink cartridge is compatible with the printhead on the basis of data read out of said first and second storage means, 2) for indicating when said ink cartridge is not compatible with said printhead, and 3) for causing said ink jet printing system to perform a printing operation when the ink cartridge is compatible with the printhead.

14. An ink jet printing system, comprising:

a printhead for ejecting black ink and color ink in the form of ink droplets;

at least two ink cartridges for supplying ink to said printhead, said ink cartridges includes a data storage means for storing data of types of inks; and control means 1) for controlling said printhead in accordance with print data, 2) for judging whether said ink cartridges as mounted are compatible or incompatible with each other on the basis of the data stored in said data storage means, 3) for indicating when said ink cartridges are not compatible with one of each other and the printhead, and 4) for causing said ink jet printing device to perform a printing operation when said ink cartridges are compatible with each other.

15. An ink jet printing process using a printhead for ejecting ink in the form of ink droplets, an ink cartridge for supplying ink to said printhead, and control means for controlling said printhead in accordance with print data, the ink jet printing process comprising the steps of:

storing data of types of printheads using a first storage means;

storing data associating a kind of ink contained in said ink cartridge and types of print-heads compatible with said ink cartridge using a second storage means, provided on the ink cartridge, said data being determined and stored in said second storage means before said ink cartridge is inserted into an ink jet printing system;

judging whether or not the ink cartridge is compatible with the printhead on the basis of data read out of said first and second storage means;

indicating when said ink cartridge is not compatible with said printhead; and causing said ink jet printing system to perform a printing operation when the ink cartridge is compatible with the printhead, wherein said judging, said indicating and said causing are performed with a control means.

16. An ink jet printing process, comprising the steps of:

ejecting black ink and color ink in the form of ink droplets using a printhead;

supplying ink to said printhead using at least two ink cartridges, said ink cartridges including a data storage means for storing data of types of inks;

controlling said printhead in accordance with print data;

judging whether said ink cartridges as mounted are compatible or incompatible with each other on the basis of the data stored in said data storage means;

indicating when said ink cartridges are not compatible with another and the printhead; and causing said ink jet printing device to perform a printing operation when said ink cartridges are compatible with each other, wherein said judging, said indicating and said causing are performed with a control means.

17. An ink jet printing process using an ink cartridge having a printhead, comprising the steps of:

providing a housing containing ink therein;

supplying ink in said housing to the printhead of the printing device using an ink supply port; and storing data associating a kind of the ink contained in said housing and types of printheads compatible with the ink cartridge using a storage device provided on said housing, said data being determined and stored in said storage device before said ink cartridge is inserted into an ink jet printing device.

18. An ink jet printing process using an ink cartridge having a printhead, comprising the steps of:

providing a housing containing ink therein;

supplying ink in said housing to the printhead of the printing device using an ink supply port; and storing data, representative of kinds of inks that may be used if those kinds of inks are properly combined for printing, and storing data regarding the compatibility of the ink cartridge with another ink cartridge using a storage device provided on the ink cartridge.

19. An ink jet printing process using an ink cartridge having a printhead, comprising the steps of:

providing a housing containing ink therein;

supplying ink in said housing to the printhead using an ink supply port disposed on said housing; and storing data associating a kind of ink contained in said ink cartridge and types of printheads compatible with said ink cartridge and a quantity of one ink droplet ejected from each type of the printhead, using a storage device provided on said housing, said data being determined and stored in said storage device before said ink cartridge is inserted into an ink jet printing device.

* * * * *